US005174211A

United States Patent [19]

Snead

[11] Patent Number: 5,174,211

[45] Date of Patent: Dec. 29, 1992

[54] PANEL TRACK DELIVERY SYSTEM

[76] Inventor: Edwin D. Snead, 701 E. University Ave., Georgetown, Tex. 78626

[21] Appl. No.: 740,428

[22] Filed: Aug. 5, 1991

[51] Int. Cl.[5] ..... E01B 29/02

[52] U.S. Cl. ..... 104/3; 414/339; 238/15; 238/50; 238/52; 238/121; 105/3

[58] Field of Search ..... 104/3; 105/3, 4.1; 414/339; 238/10 R, 15, 50, 51, 52, 53, 121

[56] References Cited

U.S. PATENT DOCUMENTS

| | | | |
|---|---|---|---|
| 554,728 | 2/1896 | Redifer | 238/52 |
| 680,153 | 8/1901 | Jackson . | |
| 766,184 | 8/1904 | Hall | 238/52 |
| 805,881 | 11/1905 | Ritchie | 104/3 |
| 995,065 | 6/1911 | Hurshman | 238/52 |
| 1,101,335 | 6/1914 | Sargent . | |
| 1,402,859 | 1/1922 | Hare | 238/51 |
| 1,659,178 | 2/1928 | Wilson | 238/10 R |
| 1,663,811 | 3/1928 | Mueller . | |
| 1,844,914 | 2/1932 | Lewis | 104/3 |
| 2,493,010 | 1/1950 | McDonald | 238/10 R |
| 2,567,178 | 8/1951 | Bird . | |
| 2,696,791 | 12/1954 | Boulard | 104/3 |
| 3,283,926 | 11/1966 | Eckhardt | 414/339 |
| 4,566,389 | 1/1986 | Theurer | 104/3 |
| 4,723,886 | 2/1988 | Frederking | 414/339 |
| 4,911,599 | 3/1990 | Theurer et al. | 414/339 |
| 4,958,977 | 9/1990 | Smead | 414/339 |

FOREIGN PATENT DOCUMENTS

| | | | |
|---|---|---|---|
| 621652 | 11/1935 | Fed. Rep. of Germany . | |
| 2535359 | 5/1984 | France . | |
| 1180439 | 9/1985 | U.S.S.R. . | |
| 352384 | 7/1931 | United Kingdom . | |
| 898911 | 6/1962 | United Kingdom | 105/458 |

*Primary Examiner*—Robert J. Oberleitner
*Assistant Examiner*—Kevin D. Rutherford
*Attorney, Agent, or Firm*—Harrison & Egbert

[57] ABSTRACT

A system for the laying of panel track that includes a plurality of panel tracks, a railroad car containing the panel tracks, and a panel track lifter positioned in the railroad car for lifting the panel tracks from the railroad car and for placing the panel tracks exterior of the railroad car. Each of the panel tracks includes a first rail, a second rail, a plurality of ties extending between and beneath each of the rails, and a plurality of gage rods affixed at various locations along the rails. A tension bar extends angularly between the first and second rails so as to create a curvature in the rails. The railroad car includes a material container having a generally flat floor extending between a pair of side walls. The material container has trucks suitable for rolling along a panel track. The material container is made up of a plurality of railroad cars having a flat floor extending throughout the plurality of railroad cars. Each of the railroad cars is in articulated connection to an adjacent railroad car. The unloader is a tractor/bucket that is movable along the flat floor of the material container. A suitable arrangement of chains with a centrally located hook, engaged by the bucket, accompanies the unloader so as to releasably attach to a panel track.

10 Claims, 3 Drawing Sheets

PANEL TRACK DELIVERY SYSTEM

TECHNICAL FIELD

The present invention relates to methods and apparatus for the delivery and installation of panel track sections. More particularly, the present invention relates to panel track and apparatus used to position the panel track so as to form a length of railroad track.

BACKGROUND ART

Panel track is used in the railroad industry for the formation of lengths of railroad track. Panel track is a short length of railroad track that is normally preformed for delivery to a desired location. In contrast to regular railroad tracks, panel track is meant for temporary use and installation. Panel track is often installed as branches of railroad track that are intended for infrequent use. The installation of a long length of panel tracks is not a permanent installation. The ties of the panel track rest on the surface of the earth, rather than embedded into the earth.

Heretofore, it was very difficult to install panel track in remote locations. Trucks, or specialty railroad equipment, were required to haul the panel tracks to a desired location for installation. Heavy lifting equipment was required so as to remove and place each of the panel track sections. Specialty railroad equipment was also developed so as to receive and place the panel track. The special panel track laying equipment is usually expensive and single purpose equipment.

In the past, it has been difficult to form curved sections of panel track. Normally, panel track is assembled in straight lengths of track. The final result of panel track installation was always a straight section of track. Attempts in the past to create curved sections of panel track have not been successful. The spring-like effect of the rail would generally cause distortions in the parallelism of the track. It was also difficult to determine the degree of curvature that would be required for the final assembled length of panel track. There was no way to adjust the panel track in the field so as to change the degree of curvature of any curved lengths of track.

There is a need for the ability to easily install panel track. Presently, in the delivery of aggregate materials, it is difficult for trains to service remote areas of the country. When train service is impossible, it becomes necessary for trucks to haul the aggregate load. Trucks are a less efficient and a more expensive technique than trains for the delivery of aggregates to remote locations.

The present inventor was a co-inventor on U.S. Pat. No. 4,925,356, issued on May 15, 1990, and entitled "Self-Unloading Train for Bulk Commodities". This patent described a self-unloading train for the delivery of aggregates to remote locations. The "Dump Train" is presently being manufactured by Conveying & Mining Equipment, Inc. of Houston, Tex. With the advent of the Dump Train, it became possible for railroad systems to service remote locations and to deliver aggregate to locations without dumping facilities. This invention greatly enhanced the ability of the railroad industry to serve areas that would otherwise have to be served by trucks. The Dump Train is, of course, somewhat limited by the location of the railroad tracks. If it is necessary to deliver a load to a location which does not have such railroad tracks, then the Dump Train must travel to the nearest location and transfer its load to trucks. In view of this circumstance, it would be extremely desirable to be able to create railroad tracks for the purpose of allowing the Dump Train, or other rail vehicle, to service such remote locations.

The present inventor is also the owner of U.S. Pat. No. 4,598,977, which issued on Sep. 25, 1990, and is entitled "System for the Transport of Bulk Commodities". This device is presently being manufactured and sold under the trademark "Slot Machine". This device is a continuous gondola car system in which a tractor/-bucket traverses the length of the continuous gondola car for the purpose of unloading materials from the continuous gondola car. The material container of this transport system has a generally flat floor that extends between a pair of side walls. Specifically, a plurality of railroad cars are employed. Each of the railroad cars is articulated to an adjacent car. The floor comprises a series of floor segments overlapping each other in the same direction. The side walls include a special mechanism that allow the cars to articulate with respect to one another, without losing portions of the load. The "Slot Machine" is capable of hauling bulk materials, trash, or a variety of other materials. This system employs a standard Caterpillar tractor/bucket having a size suitable for fitting between the side walls of the material container.

It is an object of the present invention to provide a panel track delivery system that allows panel track to be delivered easily and inexpensively.

It is another object of the present invention to provide a panel track delivery system that employs non-specialty railroad equipment.

It is another object of the present invention to provide a panel track that can be delivered in curved sections.

It is a further object of the present invention to provide a panel track delivery system that greatly enhances the ability of trains to deliver products to remote areas.

These and other objects and advantages of the present invention will become apparent from a reading of the attached specification and appended claims.

SUMMARY OF THE INVENTION

The present invention is a system for the laying of panel track that comprises a plurality of panel tracks, a railroad car containing the panel tracks, and a panel track lifting system positioned within the railroad car for lifting the panel tracks from the railroad car so as to place the panel tracks in a position exterior of the railroad car.

Each of the curved panel tracks comprises a first rail, a second rail, a plurality of ties extending between and beneath the first and second rails, and gage rods affixed at one end to the first rail and at the other end to the second rail. The first and second rails are positioned in parallel relation to each other. The gage rods serve to fix and maintain the first and second rails in parallel relation. Two tension bars extend angularly between the first and second rails. The tension bars are affixed to the first and second rails so as to exert a force on the rails for causing the curvature of the panel track. Specifically, each of the tension bars comprises a first rod connected at one end to the first rail, a second rod connected at one end to the second rail, and a turnbuckle connecting the first and second rods. The turnbuckle is adjustable so as to effect a degree of curvature in the first and second rails. A first gage rod is affixed at one position relative to the first and second rails. The second, third and fourth gage rods are affixed at positions distal the first gage rod. One tension bar has one end adjacent the connection of the first gage rods and the first rail. This first tension bar has its other end attached to the connection of the second gage rod and the second rail. A second tension bar has one end attached to the connection of the third gage rod and the second rail. This second tension bar has its other end attached to the connection of the fourth gage rod and the first rail.

The railroad car of the present invention comprises a material container for receiving the panel tracks in a stacked manner. The material container has a generally flat floor extending between a pair of side walls. The material container also has trucks suitable for rolling along a section of panel track or regular railroad tracks. Within the concept of the present invention, the material container comprises a plurality of railroad cars. The flat floor extends through this plurality of railroad cars. Each of the railroad cars is articulated to an adjacent railroad car.

The panel track lifting system comprises an unloader that is movable along the flat floor of the material container. The unloader includes a tractor positioned between the side walls of the material container. The tractor allows the unloader to be selectively moved longitudinally along the floor. The unloader also includes a bucket which is articulated to the tractor. A sling arrangement of chains connected to a hook is provided for releasably attaching to the panel track. The bucket is used to engage the hook arrangement. The unloader is rotatable so as to allow- the panel track to be delivered.

The present invention is also a method of assembling panel track that comprises the steps of (1) stacking a plurality of panel tracks onto a railroad car, (2) transporting the railroad car to a desired location, (3) lifting a first panel track from the top of the stacked plurality of panel tracks, and (4) moving the first panel track from the stacked plurality to a position exterior of the railroad car. The first panel track is affixed to an adjacent railroad track so as to form a generally continuous rail. The railroad car can then be moved from the railroad track to the first panel track. The method further includes the steps of lifting a second panel track from the top of the stacked plurality, moving the second panel track to a position exterior of the railroad car so as to align with an end of the first panel track, and affixing the second panel track to the first panel track.

The step of stacking includes the steps of lifting the plurality of panel tracks from a location exterior of the railroad car and arranging these panel tracks in a stacked order corresponding to the desired configuration of the assembly of the pan 1 tracks.

The method of the present invention further includes the steps of: (1) moving a final panel track from the stacked plurality, (2) moving the unloader along the floor of the railroad car so as to be adjacent a second stack of panel tracks, and (3) lifting a first panel track from the top of the second stack. The unloader is then returned along the floor to a position adjacent an end of the railroad car. The unloader is rotated such that the panel track is positioned exterior of the railroad car. The panel track is then lowered by the unloader such that the panel track is in alignment with an affixed panel track.

DETAILED DESCRIPTION OF THE INVENTION

Figure 1:
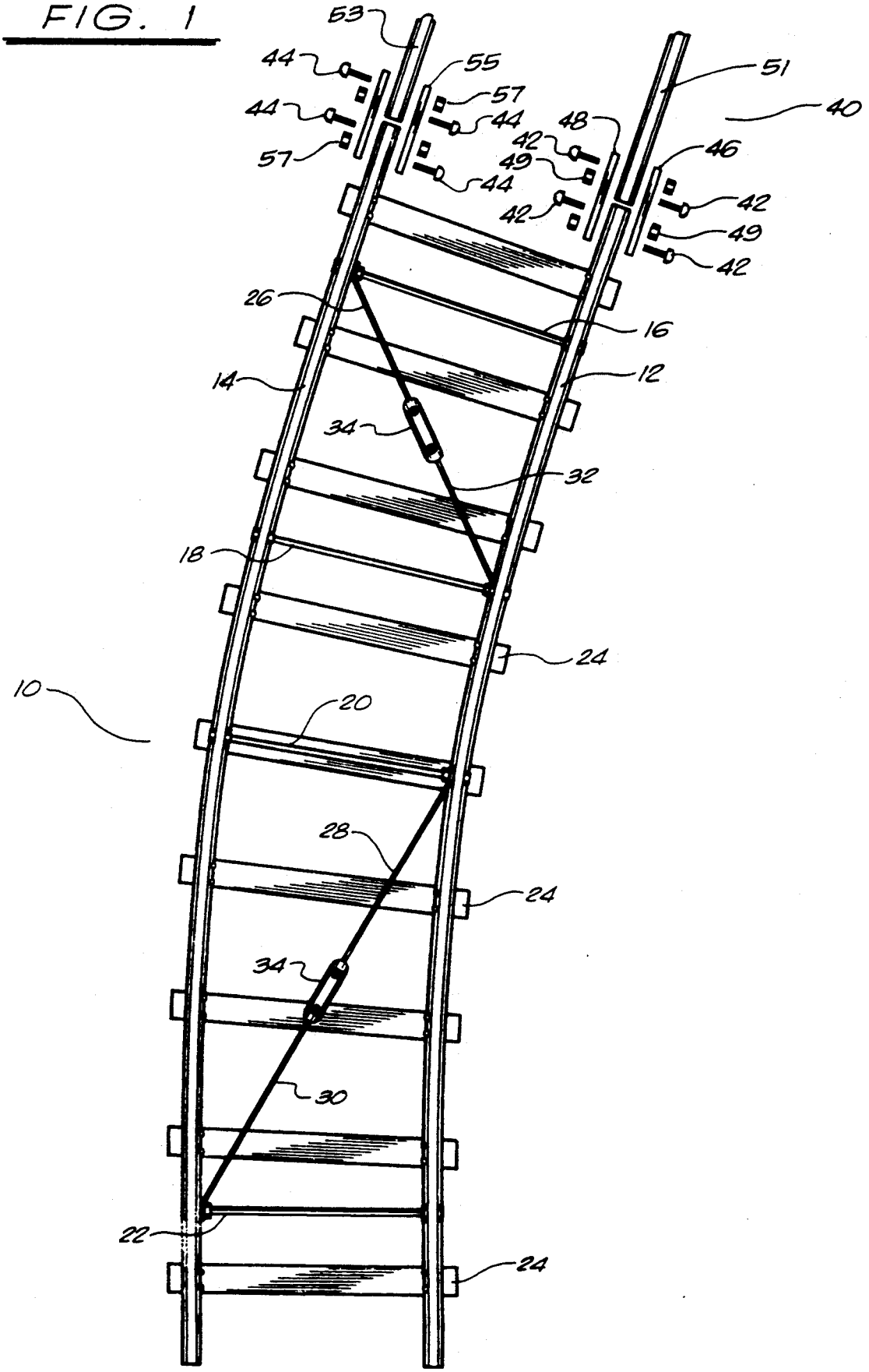
FIG. 1 is a top view of a panel track section in accordance with the preferred embodiment of the present invention. This view includes a partially exploded area showing the connection of a panel track section to an adjacent panel track section.

Referring to FIG. 1, there is shown at 10 the panel track in accordance with the present invention. Panel track 10 comprises a first rail 12, a second rail 14, gage rods 16, 18, 20, and 22, and railroad ties 24. Tension bars 26 and 28 extend at acute angles between the first rail 12 and the second rail 14.

First rail 12 and second rail 14 are conventional sections of railroad track. In order to properly serve as railroad track, the rails 12 and 14 must be maintained in parallel relation. Conventional sections of panel track have always been straight. However, many times it is necessary for the track to curve in order to conform with the terrain or to serve particular needs. It is critical for the functioning of the panel track that, whether curved or straight, each of the rails must be maintained in parallel. To effectuate this result, gage rods 16, 18, 20 and 22 are positioned at various locations along the length of the rails 12 and 14. The gage rods are positioned perpendicular to the rails that they are attached to. Each of the gage rods 16, 18, 20 and 22 are rigidly affixed to the rails using one inch bolts welded at the ends of each gage rod. The rails 12 and 14 are supported on ties 24. Typically, the rails 12 and 14 are spiked to the ties 24. In normal use, the ties 24 will rest on the surface of the earth. For long term use, it would be necessary to embed the ties 24 in ballast.

As can be seen, the tension bars 26 and 28 extend at angles from the first rail 12 to the second rail 14. The configuration of the tension bars 26 and 28 is such as to cause the forces imparted by the tension bars 26 and 28 to create a curve in the panel track 10. These tension bars 26 and 28 are also used to maintain and to stabilize the curvature of the track. Simultaneously, the gage rods 16, 18, 20 and 22 maintain the parallelism of the track throughout this curve. Each of the tension bars 26 and 28 has a first rod 30 which is connected at one end to the first rail 12 adjacent to the connection of the gage rod 16 (or 22) with the rail. A second rod 32 is connected at one end to the second rail 14 adjacent to the connection with the gage rod 18 (or gage rod 20). A turnbuckle 34 connects the other ends of rods 30 and 32. The turnbuckle 34 is adjustable so as to effect the curvature of the first rail 12 and the second rail 14. By properly rotating the turnbuckles 34, the desired curvature of the track can be achieved. The turnbuckle 34, when rotated, drawings the rods 30 and 32 inwardly. If necessary, the turnbuckle 34 can be adjusted, as needed at the work site, so as to allow minor adjustments to the curvature of the track. Each of the tension bars 26 and 28 are attached at their ends by the one inch bolt s in the corresponding gage rods.

The first tension bar 26 has a first end connected to the first gage rod 16 and the second rail 14. The other end of the first tension bar 26 adjoins the second gage rod 18 and the first rail 12. The second tension bar 28 has a first end adjoining the third gage rod 20 and the first rail 12. The other end of the second tension bar 28 adjoins the fourth gage rod 22 and the second rail 14. This arrangement of the tension bars 26 and 28 allows a curvature to be formed in the track 10. If it is desired to create a curve to the left (as opposed to the right in FIG. 1), then the tension bars 26 and 28 can be rearranged so as to allow curvature to be effected in this direction.

In FIG. 1, it can be seen that the panel track section 10 is designed to be connected to a second panel track section 40. The second panel track section 40 is positioned generally adjacent to the end of the first panel track section 10. The first panel track section 10 is secured to the second panel track section 40 by a plurality of bolts 42 and 44. The bolts 42 pass through flange plates 46 and 48. Each of the bolts 42 is secured, on its opposite side, by appropriate nuts 49. As such, the first rail 51 of the second panel track section 40 is joined to the first rail 12 of the first panel track section 10. Similarly, the second rail 53 of the second panel track section 40 is joined to the second rail 14 of the first panel track section 10 by bolting the bolts 44 through flange plates 55. Each of the bolts 44 is secured with nuts 57. By joining the first panel track section 10 to the second panel track section 40, a continuous length of track is created.

It should be noted that, in FIG. 1, the panel track section 10 has an illustrated curvature which is greater than that conventionally used on track. The curvature of the track 10 of FIG. 1 is for the purposes of illustrating the present invention. In normal use, the track 10 will have a much smaller degree of curvature.

Figure 2:
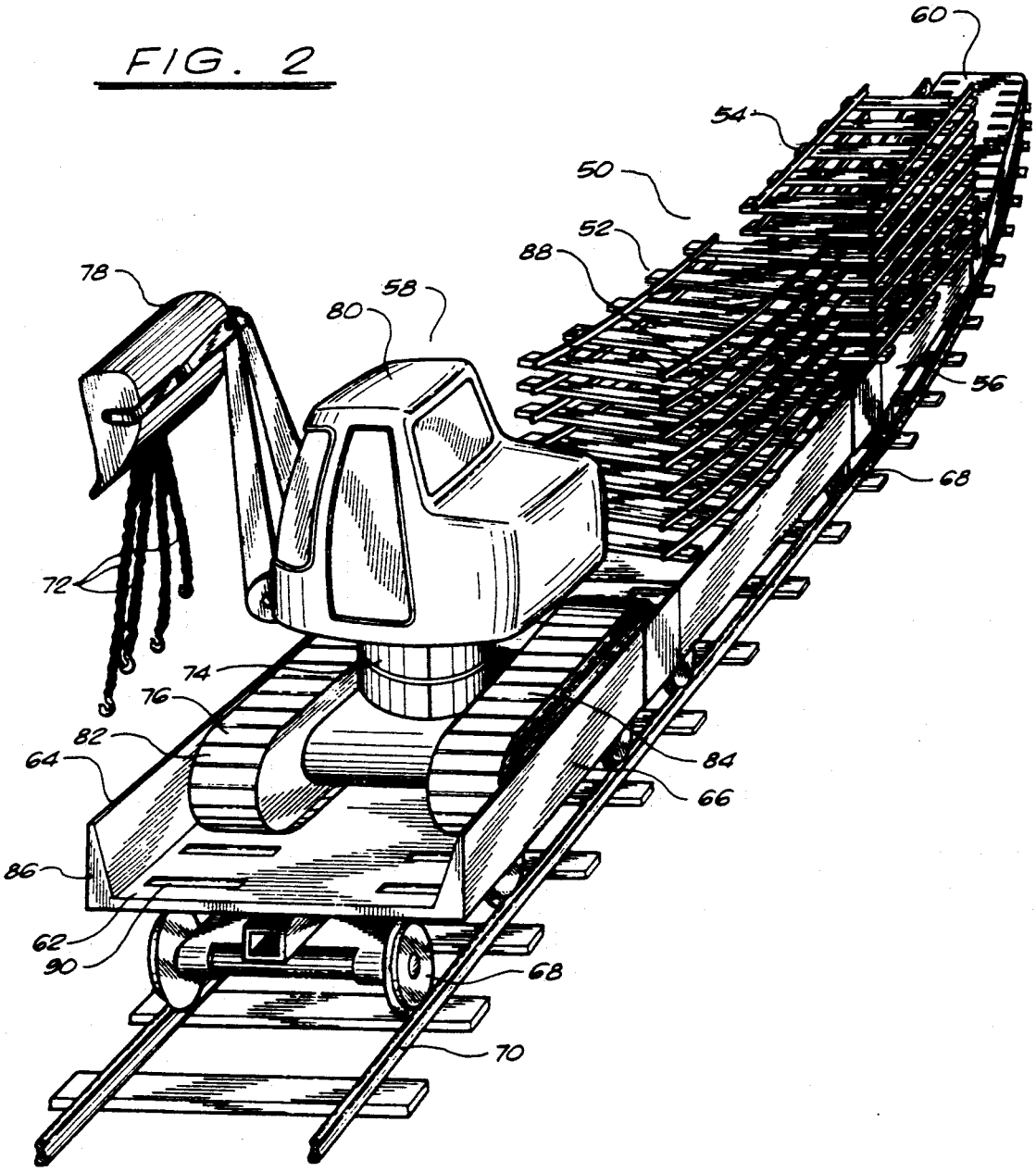
FIG. 2 is a perspective view of the system of the preferred embodiment of the system of the present invention.

Referring to FIG. 2, there is shown at 50 the system for the laying of the panel track in accordance with the preferred embodiment of the present invention. The system 50 employs a plurality of panel tracks 52 and 54, a railroad car 56, and a panel track lifting system 58. The railroad car 56 contains the panel tracks 52 and 54. The panel track lifting system 58 is positioned within the railroad car 56 so as to be in a position to lift the panel tracks 52 and 54 from the railroad car and place the panel tracks to the exterior of the railroad car 56.

In FIG. 2, each of the panel tracks 52 are of a configuration similar to that described in connection with the panel track 10 of FIG. 1. In particular, these panel tracks 52 employ gage rods, and tension bars, so as to maintain the parallelism of the railroad tracks on each of the panels 52. Panel tracks 54 are straight sections of panel track. Tension rods (in an "x" configuration) aid the straight sections of panel track in maintaining proper parallelism. It is not necessary to employ the use of the gage rods on the straight sections of track 54.

It can be seen in FIG. 2 that the stack of panel tracks 52 is made up solely of curved sections of track. The stack 54 is made up of straight sections of track. This is not to be construed as a limitation on the present invention. Various straight sections of track 54 may be intermingled or mixed into the stack 52. The intended goal of the present invention is to arrange the panel tracks 52 and 54 in the stacks corresponding to the desired design of the panel track layout. For example, in order to form a curve, it may be necessary to attach three curved sections of panel tracks 52. If a straight section follows the curve, then there may be four sections of tracks 54. As such, the stack 52 could employ, sequentially, from top to bottom, three sections of curved track and four sections of straight track. The arrangement of the stack is dependent upon the desired configuration of the ultimate panel track layout.

The railroad car 56 is a material container for receiving the panel tracks 52 and 54 in a stacked manner. The material container 60 has a generally flat floor 62 that extends between a pair of side walls 64 and 66. The material container 60 includes suitable trucks 68 that are suitable for rolling along a section of panel track or along regular railroad track. In FIG. 2, it can be seen that the railroad car 56 is in rolling relation to the railroad track 70. Railroad track 70 is a standard section of railroad track or an arrangement of panel track sections.

Specifically, the material container has a configuration similar to that described in U.S. Pat. No. 4,958,977, issued on Sep. 25, 1990, to the present inventor. Specifically, the configuration of the railroad car 56 is known commercially as a "Slot Machine". The material container 60 is comprised of a plurality of railroad cars. The flat floor 62 extends throughout the plurality of railroad cars so as to form a generally flat roadway. Each of the railroad cars is in articulated connection to an adjacent railroad car. The railroad cars 56 have a floor that overlaps a portion of the floor of an adjacent railroad car. The overlapping is in the same direction throughout the plurality of railroad cars. The panel track stacks 52 and 54 are loaded into the interior of the railroad car 56 between the side walls 64 and 66. The width of the railroad car 56 will accommodate the size of curved sections of track 52.

In order to properly lay the panel tracks 52 and 54, an unloader 58 acts as the panel track lifting system of the present invention. The unloader 58 is movable along the flat floor 62 of the material container 60. The unloader 58 has four chains 72 which are centrally joined that are used to lift the panel track sections. The chains are connected to bucket 78 of unloader 58. The unloader 58 is rotatable about turntable 74 so as to allow the engagement member 72 to rotate 180 degrees relative to the railroad car 56. Specifically, the unloader 58 includes a tractor 76 that extends between the side walls 64 and 66 of the material container 60. The tractor 76 selectively moves the unloader 58 longitudinally along the floor 62 of train 56. A bucket 78 is articulated to the tractor cab 80, to the turntable 74, and to the tractor 76. The bucket 78 is of a conventional size. The tractor 76 is made up of crawlers 82 and 84. The cab 80 of unloader 58 is mounted on turntable 74. Turntable 74 allows the device to pick up a panel track 52 and rotate 180 degrees toward the rear end 86 of material container 60. The operator will sit within the cab 80 on the unloader 58. As shown in FIG. 2, the unloader resembles a Caterpillar Model No. 215 or No. 225 tractor/bucket. It has been found that this type of unloader 58 is satisfactory for the purposes desired.

The chain arrangement 72 engages panel track section 52 or 54. The track can then be lifted, rotated, and deposited as needed. A plurality of slots (or slats) 90 are provided on the floor 62 of the material container 60. The slots 90 accommodate the grousers of the crawlers 82 and 84 of tractor 76. They provide some resistance to any undesirable movement of the unloader 58.

Figure 3:
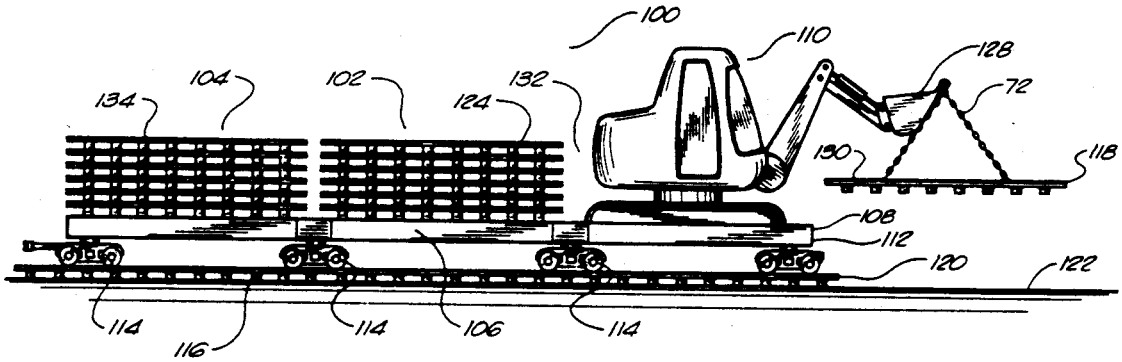
FIG. 3 is a side elevational view showing the laying of panel track in accordance with the method of the present invention.

FIG. 3 shows the operation of the panel track positioning system 100. Initially, a first panel track stack 102 and a second panel track stack 104 are loaded onto the railroad car 106. Each of the stacks 102 and 104 should have a configuration suitable for matching the desired arrangement of the completed panel track layout. Each of the stacks 102 and 104 may have intermixed sections of straight track and curved track. The panel tracks 102 and 104 are maintained within the side walls 108 of the railroad car 106. The unloader 110 is also placed between the side walls 108 of railroad car 106 at the end 112 of the railroad car 106. The unloader 110 may be used to load the panel track stacks 102 and 104 in their desired locations on board the railroad car 106. As shown in FIG. 3, the railroad car 106 is supported by trucks 114 on the railroad track 116. For the purposes of description, the railroad track 116 can be an arrangement of panel track sections, or can be a standard railroad line. The railroad track 160 is essentially any railroad track that requires the addition of a panel track section 118 to the end 120 of the railroad track 116. The railroad track 116 is shown as supported on the earth 122.

The operation of unloading the panel track and installing the panel track, as needed, is described hereinafter. Initially, the unloader 110 will engage a top panel track 124 on stack 102. As described herein previously, the four chain arrangement 126 attaches to the panel track section 124. Alternatively, other track panels in the panel track stack 102 would be available for attachment. The attachment arrangement 72 can take on a variety of configurations that are suitable for lifting the panel track sections from the stacks 102 and 104.

After the bucket 128 causes the attachment arrangement 72 to engage the top panel track section 124 of stack 102, the unloader 110 rotates about its turntable 180 degrees. In this position, the bucket 128 is extending outwardly beyond the end 112 of railroad car 106. The bucket 128 is extended for such a distance that the end 130 of panel track section 118 clears the end 112 of the railroad car 106. The bucket 128 is lowered toward the earth 122 such that the end 130 rests in close proximity to the end 112 of railroad track 116. In this position, the bucket 128 is manipulated so as to release the attachment arrangement 72 from the panel track section 118. The end 130 of panel track section 118 and the end 120 of railroad track 116 can then be joined in conventional fashion. Once the panel track section 118 is joined to railroad track 116, a motive power is supplied to the railroad car 106 so as to cause the trucks 114 to roll from railroad track 116 onto and over the panel track section 118. The unloader 110 is then rotated such that the bucket 128 comes into close proximity and engagement with the next top panel track section 132. The attachment arrangement 72 is used to engage such panel track 132. The unloder 110 rotates, deposits, and continues the process of building the railroad track.

An air impact wrench may be used to tighten the track bolts which hold the angle bars tight against the ends of the rails. Compressed air for this wrench is supplied by the locomotive at the opposite end of the Slot Machine from where the track panels are being laid. An air hose runs along the full length of the Slot Machine to deliver the compressed air to the wrench.

Ultimately, when the tracks in the panel track stack 102 are exhausted, the floor of the railroad car 106 will be clear of obstruction. The unloader 110 is then free to move toward the second panel track stack 104. The bucket 128, with its attachment arrangement 72, can then lift the top panel track 134 from stack 104. When it is necessary to deposit the panels from stack 104, the unloader 110 must traverse back and forth along the flat floor of the railroad car 106. Eventually, when the unloader 110 comes to the end 112 of the railroad car 106, the unloader 110 will then deposit the panel track 134 in the manner illustrated in FIG. 3. This process continues until the desired panel track layout is completed.

Figure 4:
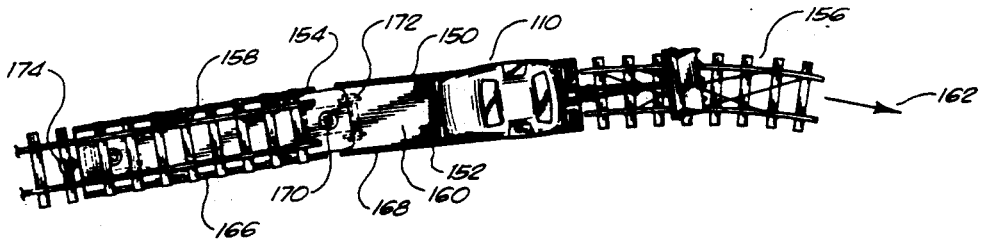
FIG. 4 is a top view showing the process of laying of panel track.

FIG. 4 further illustrates the configuration of the system of the present invention. In particular, it can be seen that the unloader 110 is contained within the side walls 150 and 152 of the railroad car 154. The unloader 110 deposits the panel track section 156 rearward of the railroad car 154. As can be seen, a curved section of panel track 156 is deposited onto the earth 122.

In order to obtain the next panel track section 158, the unloader 110 will crawl along the flat floor 160 of the railroad car 154. The unloader 110 will move back and forth until the panel tracks 158 of the stack are exhausted. The railroad car 154 will then be moved in the direction of the arrow 162 so as to be in position to deposit the next section of panel track.

In FIG. 4, it can be seen that railroad car 166 is connected to railroad car 168 by an articulated connection 170. In other words, the railroad cars 166 and 168 pivot about point 170 and share the trucks 172. A coupler 174 is provided at the end of railroad car 154 so as to allow the train to be connected to a source of power, to additional cars, or to other railroad equipment.

The present invention allows panel track to be easily installed in locations otherwise inaccessible by trains. The ability to use standard railroad equipment, such as the Slot Machine, to accommodate the placing of panel track, is a significant improvement over prior equipment required for panel track assembly. The Slot Machine can accommodate a large number of panel track sections so as to generally complete the required panel track layout. The ability to lay panel track in the manner described herein previously allows otherwise remote locations to be accessible by aggregate delivery vehicles, such as the Slot Machine or the Dump Train. Also, operators can easily manipulate the Caterpillar buckets so as to pick up, position, and release panel track. No expensive specialty equipment or specialty training is required for the operation of the present invention. An ordinary bucket operator can manipulate the bucket in the manner described herein previously so as to accomplish the purposes desired by the present invention.

The panel track envisioned by the present invention allows for the development of curved sections of panel track and for the adjustment of the panel track at the work place. Curved sections can be adjusted without affecting the parallelism of the rails.

The foregoing disclosure and description of the invention is illustrative and explanatory thereof. Various changes in the details of the illustrated construction, or in the details of the method of the present invention, may be made within the scope of the appended claims without departing from the true spirit of the invention. The present invention should only be limited by the following claims and their legal equivalents.

I claim:

1. A system for the laying of panel track comprising:

a plurality of panel tracks comprising:

a first rail;

a second rail;

a plurality of ties extending between and beneath said first and second rails, said first and second rails positioned in parallel relationship to each other;

at least one gage rod affixed at one end to said first rail and at another end to said second rail, said gage rod for fixing said first and second rails in parallel relationship; and at least one tension bar extending at an acute angle between said first and second rails, said tension bar comprising:

a first rod connected at one end to said first rail;

a second rod connected at one end to said second rail; and a turnbuckle connecting said first and second rods, said turnbuckle adjustable so as to effect a degree of curvature of said first and second rails;

a railroad car containing said panel tracks; and a panel track lifting means movably positioned in said railroad car for lifting said panel tracks from said railroad car so as to place said panel tracks exterior of said railroad car.

2. The system of claim 1, each of said plurality of panel tracks comprising:

a first gage rod affixed at one position relative to said first and second rails; and a second gage rod affixed at a position distal said first gage rod, said second gage rod extending perpendicular to said first and second rails, said tension bar having one end adjacent a connection of said first gage rod and said first rail, said tension bar having another end adjacent a connection of said second gage rod and said second rail.

3. A system for the laying of panel tracks comprising:

a plurality of panel tracks;

a railroad car containing said panel tracks, said railroad car comprising a material container for receiving said panel tracks in a stacked manner, said material container having a generally flat floor extending between a pair of side walls, said material container having trucks suitable for rolling along a section of panel track, said material container comprising a plurality of railroad cars, said first floor extending continuously through said plurality of railroad cars, each of said railroad cars articulated to an adjacent railroad car, said side walls extending continuously through said plurality of railroad cars;

a panel track lifting means movable along a length of said railroad cars for lifting said panel tracks from said railroad car so as to place said panel tracks exterior of said railroad car.

4. The system of claim 3, each of said railroad cars having a floor overlapping a portion of the floor of an adjacent railroad car, the overlapping being in a similar direction throughout said plurality of railroad cars.

5. The system of claim 3, said panel track lifting means comprising:

an unloader movable along said flat floor of said material container throughout said plurality of railroad cars, said unloader having an attachment arrangement for releasably attaching to a panel track, said unloader rotatable so as to transport said panel track rearward of said railroad car.

6. The system of claim 5, said unloader comprising:

a tractor means positioned between said pair of side walls of said material container, said tractor means for selectively moving said unloader means longitudinally along said floor; and a bucket articulated to said tractor means, said attachment arrangement comprising a plurality of chains with a centrally located hook to affix to said bucket.

7. The system of claim 6, said floor of said material container being in frictional relationship with said tractor means of said unloader.

8. An apparatus for the arrangement of panel track comprising:

a plurality of panel tracks arranged in a desired order in a stack;

a material container for receiving said stack of panel tracks, said material container having a generally flat floor extending between a pair of side walls, said material container having trucks suitable for rolling along a section of panel track, said material container comprising a plurality of railroad cars, said flat floor extending continuously through said plurality of railroad cars, each of said railroad cars articulated to an adjacent railroad car, said side walls extending continuously through said plurality of railroad cars; and means for unloading said panel tracks from said material container, said means for unloading contained within said material container, said means for unloading movable along said flat floor through said plurality of railroad cars.

9. The apparatus of claim 8, said means for unloading comprising:

a tractor/bucket positioned between said side walls of said material container, said tractor/bucket having a means for releasable connection to a portion of a panel track, said tractor/bucket having a turntable for allowing a bucket of said tractor/bucket to rotate for at least 180 degrees with respect to said material container.

10. The apparatus of claim 8, said material container having an open end, said means for unloading positioned adjacent said open end, said open end positioned in a location adjacent to a desired location for deposit of a panel track, said stack of panel tracks positioned on an opposite side of said means for unloading from said open end.

* * * * *